United States Patent [19]

Schweizer

[11] 4,169,650

[45] Oct. 2, 1979

[54] WIRE-WRAP ASSEMBLY CONNECTOR

[75] Inventor: William E. Schweizer, Philadelphia, Pa.

[73] Assignee: EBY Company, Philadelphia, Pa.

[21] Appl. No.: 944,087

[22] Filed: Sep. 20, 1978

[51] Int. Cl.[2] ..... H01R 13/02

[52] U.S. Cl. ..... 339/198 R; 339/177 R; 339/276 A

[58] Field of Search ..... 339/17 LC, 276 A, 276 R, 339/177 R, 177 E, 99 R, 198

[56] References Cited

U.S. PATENT DOCUMENTS

| | | | |
|---|---|---|---|
| 2,882,513 | 4/1959 | Olashaw | 361/426 X |
| 3,980,383 | 9/1976 | Dickey | 339/198 R |

*Primary Examiner*—Joseph H. McGlynn
*Assistant Examiner*—John S. Brown
*Attorney, Agent, or Firm*—Stanley Bilker

[57] ABSTRACT

A connector which is used for the termination of conductors in a wire-wrap assembly. The connector is used to terminate signal wire, twisted pair and shielded cables. It comprises a base which supports a terminal strip and a receptacle housing. The receptacle housing includes a plurality of receptacles with rearwardly extending wire-wrap prongs. The terminal strip includes forwardly extending posts and rearwardly extending tabs. Some conductors can be wrapped around the post while other conductors are engaged by clips which are connected to the tabs.

14 Claims, 4 Drawing Figures

FIG. 2
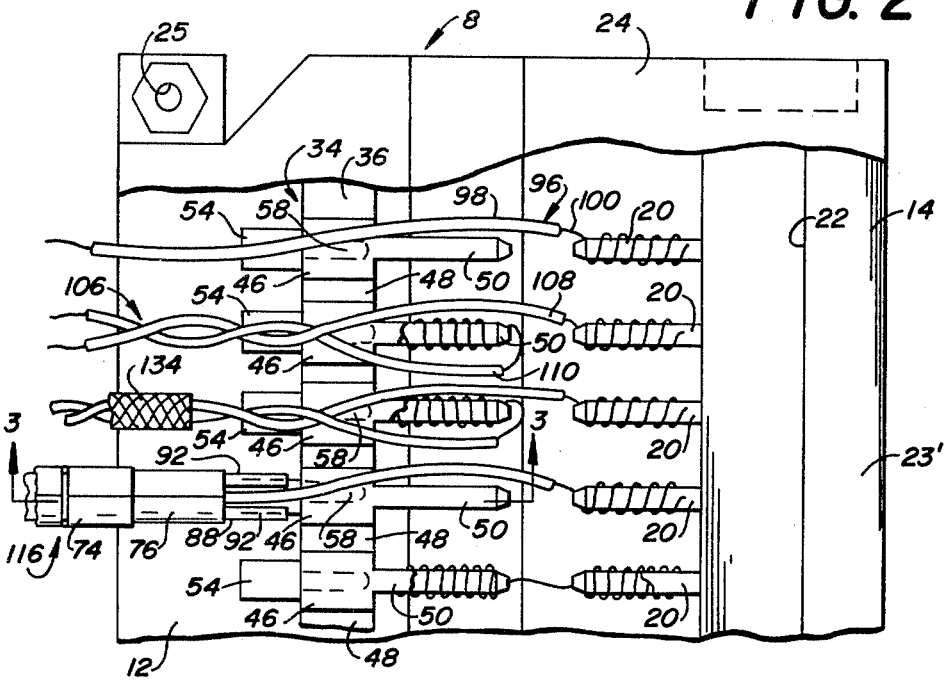
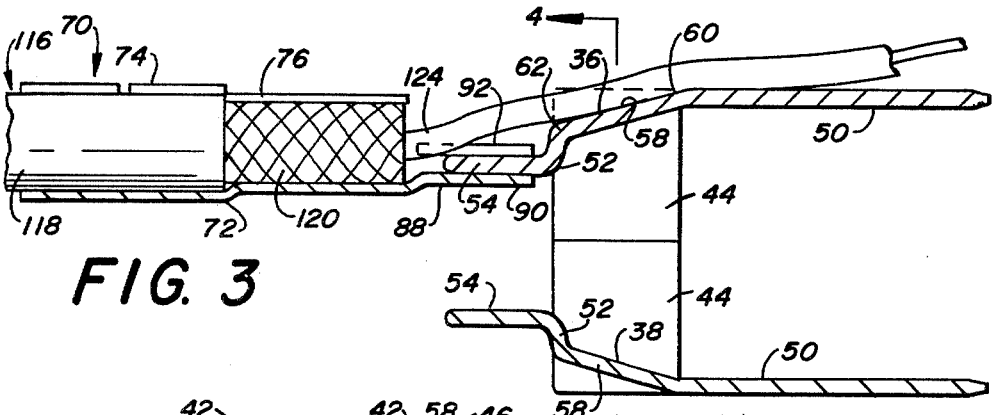
FIG. 3
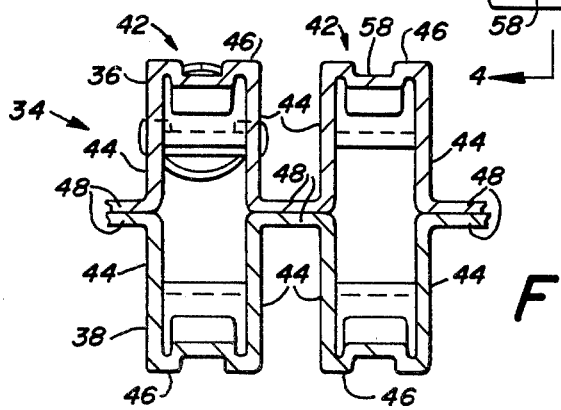
FIG. 4

WIRE-WRAP ASSEMBLY CONNECTOR

This invention relates to a connector and more particularly to a connector for solderless wire-wrap termination which can be used with different types of conductors.

The art has recognized the desirability of being able to connect a wire to another element such as a receptacle by wrapping the wire around a prong extending from the receptacle without the use of solder. Such connectors are extensively used in industry.

However, in many applications of wire-wrap connectors, it is necessary to bring more than one type of wire to a particular connector. Thus, in instances where single conductors, twisted pairs, shielded twisted pairs and shielded cables must be brought to the same connectors, there is substantial difficulty in connecting all of them to the same type of connector. This is because the different numbers of conductors and shield configurations each require different support and assembly techniques in order to accomplish effective electrical connection.

Failure to make a good electrical connection can result in the degradation of the signal which is transmitted over the conductor so that it is unusable. Further, a poor connection may result in excessive noise interfering with the signal or separation of the conductor from the connector.

To some extent these problems of signal degradation and noise have been dealt with by the use of shielded cables and by twisted wires. However, improper or inadequate connection of these wires at the connector may result in a further loss of signal or increase in noise unless a suitable structure which enables these conductors to be securely and reliably connected can be created.

Thus, with the foregoing in mind one aspect of the invention relates generally to a terminal for use in a wire-wrap connector assembly. The assembly includes a housing and a plurality of receptacles. The terminal comprises an elongated strip of electrically conductive material which is supported by the housing. A plurality of generally "U" shaped elements are disposed along the length of the strip. Each of the elements includes two sides interconnected by a base. Adjacent "U" shaped elements are interconnected by webs. Each of the bases include means extending toward the receptacles for being electrically connected to an electrical conductor and means extending away from the receptacle for being electrically connected to another conductor.

Another aspect of the invention relates to a connector assembly which includes a base. The base supports a receptacle housing and terminal. The receptacle housing includes a plurality of receptacles. Each of the receptacles includes a rearwardly extending electrically conductive prong about which a conductor can be wrapped. The terminal comprises an elongated strip of electrically conductive material which is supported on said base. It includes a plurality of generally "U" shaped elements disposed along its length. Each of the "U" shaped elements including first means extending toward said prongs so that a conductor can be wrapped therearound, and second means extending away from said prongs for engagement with another conductor.

The invention can best be described by reference to the accompanying drawing wherein a presently preferred embodiment is shown and wherein FIG. 1 is a perspective view taken partially in section of a connector embodying the invention.

FIG. 2 is a plan view of the connector shown in FIG. 1.

FIG. 3 is a view taken along line 3—3 of FIG. 2, and

FIG. 4 is a view taken along line 4—4 of FIG. 3.

Figure 1:
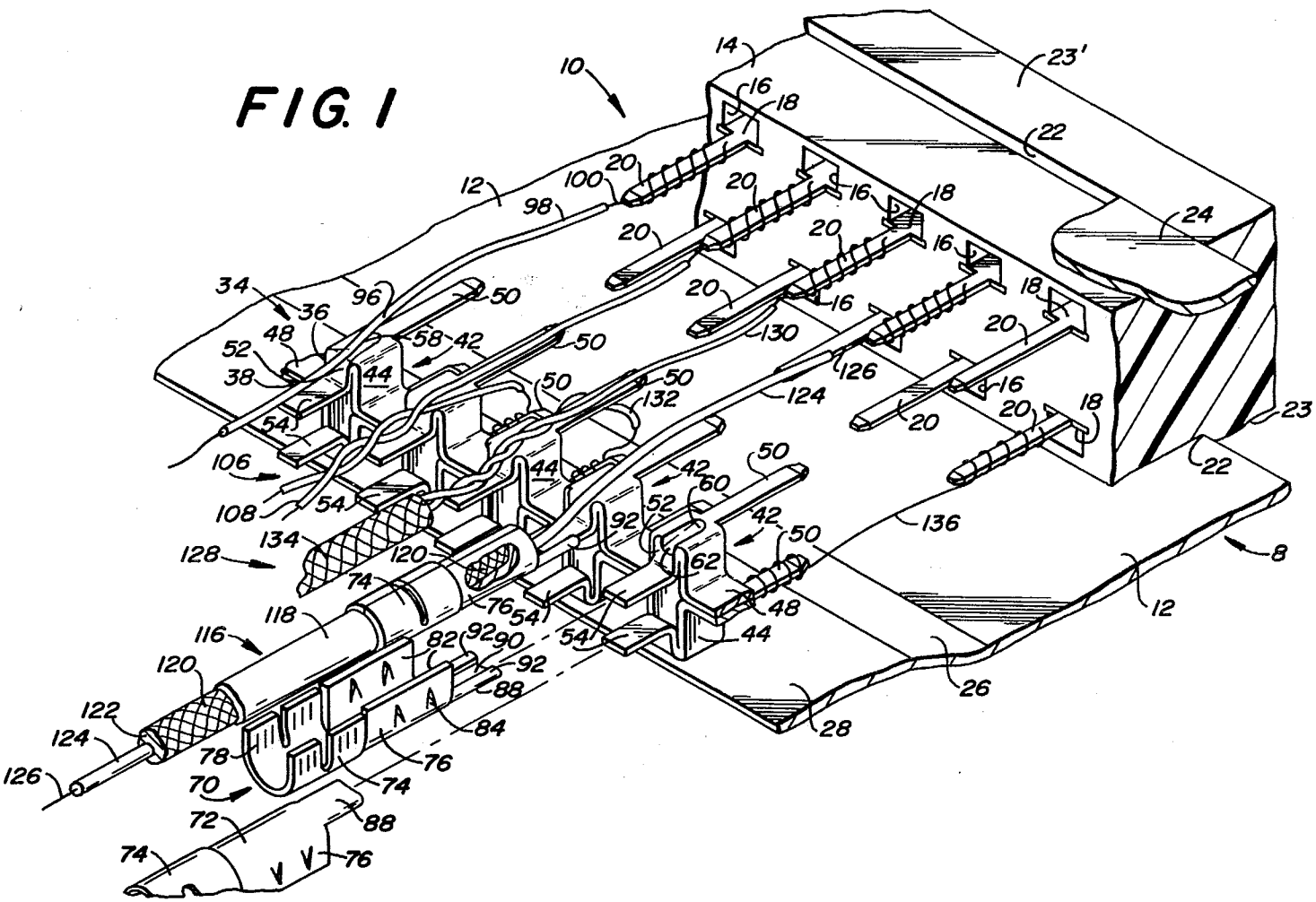

Now referring to the drawing for a detailed description of a presently preferred embodiment of the invention, the connector 10 includes a connector housing 8 which includes a base 12 and a cover 24. The base and cover may be held together by a fastener which passes through threaded apertures 25, only one of which is shown. The base and cover support a receptacle housing 14. The receptacle housing may have the shape of a rectangular solid as shown, or it may be of any other convenient shape. The housing includes a plurality of receptacle apertures 16. Preferably two parallel rows of apertures are provided. However, not all receptacle apertures need be used in any application, nor is it necessary for the operation of the invention to provide only two rows of apertures since more or less rows could be provided as desired.

Each of the receptacle apertures 16 includes an electrically conductive element 18 having an elongated rearwardly extending electrically conductive prong 20. While a plurality of receptacles 16 and prongs 20 are shown in each row, it will be apparent that only one such receptacle and its prong need be provided in order for the invention to work in the manner which will be described herein.

Both the upper and lower surfaces of the receptacle housing 14 are provided with ledges 22. The purpose of the ledges is to enable the base 12 to fit flush with the forward portion 23 of the receptacle while the cover 24 fits flush with the forward portion 23' of the top surface of the housing 14. Both the rearward portion of the base 12 and cover 24 may have an inwardly directed tapered surface 26 and rearwardly extending portion 28 connected thereto.

A terminal strip 34 is supported between the rearwardly extending portion 28 of base 12 and cover 24. The terminal strip 34 is to be connected to ground as will be described herein. It comprises upper and lower portions 36 and 38. Both the upper and lower portions 36 and 38 of the terminal strip 34 are substantially the same. Accordingly, only one need be described in detail since the same reference numerals on each portion will identify identical elements.

Considering the upper portion 36 it can be seen that it is made from a conductive strip of material which has been shaped so that it is comprised of a plurality of "U" shaped elements 42. The "U" shaped elements are disposed in side-by-side relation along the strip. They comprise sidewalls 44 which are interconnected by bases 46. Adjacent "U" shaped elements are interconnected by webs 48 which extend between the sidewalls 44 of adjacent elements 42.

In embodiments of the invention where only one portion of the terminal strip is used in a connector assembly, as for example when only one row of receptacles 16 is provided, the webs 48 and bases 46 may be held between the base 12 and cover 24. However, in those circumstances in which a sufficient number of receptacles 16 are present to warrant the use of both the upper portion 36 and the lower portion 38 of the terminal strip then the two portions are interconnected along webs 48 and the bases 46 of the respective portions lie along the cover 24 and base 12 of the connector respectively.

The base 46 of each of the "U" shaped elements 42 includes a forwardly extending post 50. The posts 50 extend toward prongs 20. Preferably each of the prongs 20 corresponds to and is in alignment with one of the posts 50. The posts 50 are integral with the bases 46 and are of a sufficient length to permit a conductor to be wrapped around them. The rear portion of each base 46 includes a lip 52 which extends toward the open side of each "U" shaped element. Where upper portion 36 and lower portion 38 are used the lips 52 face each other. A relatively flat tab 54 extends rearwardly from each of the lips 52. Preferably the tab 54 is about the same width as bases 46.

Each base 46 includes a wire guide groove 58. The forward portion 60 of the groove 58, that is, that portion of the groove 58 closest to post 50 is relatively shallow while the rear portion 62 of the groove 58 is relatively deep. The rear portion 62 of the groove 58 opens onto the aforementioned lip 52.

A clip 70 may be provided for connecting shielded cable to the terminal strip 34. The clip 70 may include an elongated central portion 72 including first and second "U" shaped members 74 and 76. "U" shaped member 74 may include a roughened inner surface 78. The inner surface may be formed by knurling or by providing ridges on the inner surface so that member 74 can grip the outer protective layer of the cable. The sidewalls 82 of member 76 may have contactors 84 for engaging the braided shield. The contactors 84 may take any convenient shape. However, it is presently preferred that they be "V" shaped elements that are die cut into the sidewalls 82. The elements may have sharp points for achieving the desired electrical connection with the braided shield. Further, the openings formed during the die cutting operation assure complete solder coverage to assure good electrical contact.

The most forwardly extending part of elongated central portion 72 comprises an upwardly facing "C" shaped element 88 that comprises an elongated bottom wall 90 and inwardly turned sidewalls 92.

Elements 88 are arranged so that they may be conveniently received in telescopic sliding engagement over the rearwardly extending tabs 54 on the aforementioned terminal strip portions 36 and 38.

The manner in which different types of conductors can be coupled to the terminal strip and to the receptacle housing will now be described.

A single wire such as the signal wire 96 which includes an insulator 98 and a conductor 100 is connected to the connector by the wire-wrap method. In this instance, the insulator 98 is removed from the end of the wire to expose the conductor 100. The wire 96 is merely placed over the terminal strip 34 so that it lies in wire guide groove 58 with the conductor 100 extending beyond the groove and being wrapped around prong 20 in a well known fashion.

In the instance of a twisted pair of wires 106, the insulator is removed from the end of each of the wires to expose their conductors. The signal wire 108 is placed over the terminal strip 34 so that it lies in one of the wire guide grooves 58 while its conductor is wrapped around one of the prongs 120. The ground wire 110 of the twisted pair also extends through groove 58. Its conductor may be wrapped around one of the posts 50. While the post 50 which is illustrated extends from the lower portion 38 of the terminal strip 34 which is immediately adjacent the "U" shaped element 42 on which the pair 106 is supported, it is apparent that it could be connected to any post since the terminal strip 34 including both its upper and lower portions 36 and 38 and all posts and tabs extending therefrom are at the same ground potential.

A shielded cable 116 is connected to the terminal strip by the clip 70. The shielded cable comprises an outer jacket 118 of nonconductive material. Within the jacket is a braided shield 120. The braided shield 120 surrounds a foam core 122 within which is a layer of insulation 124 which surrounds a conductor 126.

The cable is prepared for connection to the connector 10 by removal of a portion of the cable jacket 118 to expose the braided shield 120 and then removal of the braided shield, foam core and layer of insulation 124 to expose the end of the conductor 126.

The cable is placed within clip 70. "U" shaped member 74 is then crimped over the jacket 118 so that the cable is held securely. "U" shaped member 76 is then crimped over the braided shield 120 so that the contactors 84 are brought into close electrical contact with it. Solder can be applied to the connection through the openings around the contactors. The clip 70 can then be telescopically slipped over one of the tabs 54 on the terminal strip to make electrical contact between the shield 120 and the terminal strip 34. The conductor 126 may be wrapped around a prong 20 which extends from one of the receptacles 16 in housing 14.

A shielded twisted pair 128 may comprise a signal wire 130 and a ground wire 132. The wires 130 and 132 are wrapped around each other and are enclosed within a braided shield 134 in a manner similar to that described in connection with the shielded cable 116.

The shielded twisted pair 128 is prepared for the connector 10 by removing the braided shield, and then exposing the conductors of signal wire 130 and ground wire 132.

The signal and ground wires are passed over one of the guide grooves 58. The conductor of the signal wire can be wrapped around one of the prongs 20. The conductor of the ground wire can be wrapped around one of the posts 50. Alternatively the shielded twisted pair can be connected to the terminal 34 by securing its braided shield 134 to one of the clips 70 and then sliding that clip over a tab 58.

The terminal strip 34 may be connected to ground by wiring one of the posts 50 one of the prongs 20 by a suitable conductor 136. The connection to ground is completed by a connector such as a plug which is received in the receptacle 16 that corresponds to the last named prong.

Thus, what has been described is an electrical connector which is relatively simple to manufacture and use. It is universal in application in that it can be used with a single wire, a twisted pair, a shielded twisted pair, or a shielded coaxial cable either individually or simultaneously. Further, the connector provides a reliable connection both for the signal wire and the ground wire so that the likelihood of signal degradation and noise as a result of the connector will be minimized.

Thus, while the scope of the invention has been described with reference to a specific embodiment thereof, it is apparent that many other forms and embodiments will be obvious to those skilled in the art in view of the foregoing description. Thus, the scope of the invention should not be limited by the foregoing description but, rather, only by the scope of the claims appended hereto.

I claim:

1. A terminal for use in a wire-wrap connector assembly of the type that includes a base and a cover and where said base and said cover support a plurality of receptacles arranged in a row; said terminal comprising an elongated strip of electrically conductive material, said strip to be supported by said base and said cover, said strip including a plurality of generally "U" shaped elements disposed along its length, at least some of said "U" shaped elements corresponding to some of said receptacles and including two sides interconnected by a base with adjacent "U" shaped elements being connected by webs, each of said bases including means extending toward said receptacles for being electrically coupled to an electrical conductor, and said bases include means extending away from the receptacles for engagement with another conductor.

2. A terminal as defined in claim 1 including a clip, said clip including means for electrically contacting a conductor, and means on said clip for slidably engaging said means that extend away from the receptacles.

3. A terminal as defined in claim 2 wherein said means for electrically contacting a conductor comprises first and second generally "U" shaped members in substantial end-to-end alignment with each other, one of said last named "U" shaped members including means for gripping the outer insulating layer of the conductor which is to be connected to said terminal, and the other including means for contacting another portion of the conductor.

4. A terminal as defined in claim 3 wherein said clip includes an elongated base, said "U" shaped members are coupled to said base in end-to-end relation, and said slidably engaging means extends from said base.

5. A terminal as defined in claim 1 wherein the base of each of said "U" shaped elements includes a groove, and the rearwardly disposed portion of said groove is deeper than its forwardly disposed portion.

6. A terminal as defined in claim 1 including a second elongated strip, said second strip being substantially the same as said first strip with the webs of said strips being in electrical contact with each other and the bases of their respective "U" shaped elements being spaced from each other, and the bases of the "U" shaped elements of said strips are supported between said base and said cover.

7. A terminal as defined in claim 6 wherein said means for electrically contacting a conductor comprises first and second generally "U" shaped members in substantially end-to-end alignment with each other, one of said last named "U" shaped members including means for gripping the outer insulating layer of the conductor which is to be connected to said terminal, the other including means for contacting another portion of the electrical conductor, and means coupled to said last named means for telescopically engaging said means that extend away from the receptacles.

8. A terminal as defined in claim 2 wherein said means extending away from the receptacle is substantially flat and said slidably engaging means is "C" shaped whereby both of said last named means can slide into and remain in electrical contact with each other.

9. A connector assembly comprising connector housing, a receptacle housing supported by said connector housing, said receptacle housing including a plurality of receptacles, each of said receptacles including a rearwardly extending electrically conductive prong about which a conductor can be wrapped, a terminal, said terminal comprising an elongated strip of electrically conductive material, said strip being supported by said connector housing and including a plurality of generally "U" shaped elements disposed along its length, each of said "U" shaped elements including two sides interconnected by a base with adjacent "U" shaped elements being connected by webs, each of said "U" shaped elements including first means extending toward said prongs so that a conductor can be wrapped there around, and second means extending away from said prongs for engagement with another conductor.

10. A connector assembly as defined in claim 9 wherein said connector housing comprises a base and a cover, said base and said cover lying over and under said receptacle housing and said terminal, and means for securing said cover to said base to enclose said receptacle housing and said terminal.

11. A connector assembly as defined in claim 10 including a second elongated strip, said second strip being substantially the same as said first strip with the webs of said strips being in electrical contact with each other and the bases of their respective "U" shaped elements are spaced from each other, and the bases of the "U" shaped elements on one of said strips lie along said base of said connector and the bases of the "U" shaped elements on the other of said strips lie along said cover.

12. A connector assembly as defined in claim 11 wherein the base of the "U" shaped elements on each of said terminal strips includes mutually facing lips and said second means on each of said strips is coupled to and extends rearwardly from said lips so that conductors which are coupled tosaid terminals will be between said base and said cover.

13. A connector assembly as defined in claim 9 including a clip, said clip including first and second generally "U" shaped members in substantial end-to-end relation with each other, one of said last named "U" shaped members including means for gripping the outer insulating layer of a shielded conductor which is to be connected to said terminal, the other including means for penetrating the insulating layer to contact the shield of the conductor, and means coupled to said penetrating means for sliding into telescopic engagement with said second means.

14. A connector assembly as defined in claim 9 wherein the base of each of said "U" shaped elements includes a groove, and the rearwardly disposed portion of said groove is deeper than its forwardly disposed portion.

* * * * *